US005939677A

United States Patent [19]

Ko

[11] Patent Number: 5,939,677

[45] Date of Patent: Aug. 17, 1999

[54] ROLLER ELECTRODE FOR USE IN A CONTINUOUS ELECTROPLATING PROCESS

[76] Inventor: Chien-Hsin Ko, No. 7, Sec. 2, Chung-She Rd., Taipei City, Taiwan

[21] Appl. No.: 08/928,005

[22] Filed: Sep. 11, 1997

[51] Int. Cl.[6] ..... C25D 11/00

[52] U.S. Cl. ..... 174/68.1; 204/279

[58] Field of Search ..... 174/68.1; 204/194, 204/196, 290 R, 279; 219/84; 118/621; 191/1 A

[56] References Cited

U.S. PATENT DOCUMENTS

| | | | |
|---|---|---|---|
| 3,678,226 | 7/1972 | Hatafi et al. | 191/1 A |
| 3,839,606 | 10/1974 | Paradine | 191/1 A |
| 3,887,776 | 6/1975 | Kanbayashi | 191/1 A |
| 4,662,997 | 5/1987 | Hirt et al. | 204/28 |
| 4,733,038 | 3/1988 | Girardin | 219/69 |

*Primary Examiner*—Kristine Kincaid
*Assistant Examiner*—Mark Olds
*Attorney, Agent, or Firm*—Ostrolenk, Faber, Gerb & Soffen, LLP

[57] ABSTRACT

A roller electrode includes an elongated hollow roller, a stationary shaft, and an electrically conductive fluid. The hollow roller and the stationary shaft are electrically conductive. The hollow roller has an inner surface which confines an interior chamber. The stationary shaft is provided coaxially in the interior chamber of the hollow roller and is journalled to the hollow roller. The stationary shaft has an end section which extends out of the interior chamber for connection to a power supply. The fluid is provided in the interior chamber around the stationary shaft to provide a stable electrical connection between the stationary shaft and the hollow roller.

6 Claims, 4 Drawing Sheets

ROLLER ELECTRODE FOR USE IN A CONTINUOUS ELECTROPLATING PROCESS

BACKGROUND OF THE INVENTION

1. Field of the Invention

The present invention relates to a roller electrode for use in a continuous electroplating process in which an article is passed along a horizontal pathway, more particularly to a roller electrode which is capable of providing a stable voltage to the article.

2. Description of the Related Art

Electroplating is used in a manufacturing process for electro-depositing a layer of metal, such as nickel, cadmium, copper, silver, zinc or gold, on a surface of a product for the purpose of protection or decoration or for producing a printed circuit board.

FIG. 1 illustrates schematically a conventional electroplating process which generally involves immersion of an article 11 to be plated and a pure metal 12 in a suitable electrolyte solution 14 that is received in an electroplating tank 13. The metal 12 is formed as an anode 15, while the article 11 is formed as a cathode 16. When a direct current is applied, the metal ions contained in the electrolyte solution 14 move toward the article 11 and are reduced and deposited on the article 11. The pure metal 12 is dissolved to form the metal ions which are supplied to the electrolyte solution 14. In conducting the aforementioned dip-type electroplating process, the article 11, such as a printed circuit board substrate, must be hung above the electroplating tank 13 and then lowered for dipping into the electrolyte solution. In addition, frequent addition or replacement of the pure metal 12 is required for maintaining a sufficient ion concentration in the electrolyte solution 14. Therefore, the dip-type electroplating process is relatively complicated, labor consuming and costly.

In recent years, a continuous electroplating process has been developed to overcome the disadvantages of the dip-type electroplating process. Referring to FIG. 2, an article 21, such as a printed circuit board substrate, is passed smoothly through a plating tank 23 which contains an electrolyte solution 24 by means of a pair of negatively-charged roller electrodes 20 and a plurality of pairs of advancing rollers 25 which are in rolling contact with the article 21. An opposite pair of anode boards 22 are provided in the electrolyte solution 24 on two opposite sides of the article 21. The negatively-charged roller electrode 20 are in rolling contact with the article 21 for forming the article 21 into a cathode.

In the continuous electroplating process, the stability of the voltage provided by the roller electrodes 20 affects dramatically the quality of the coating plated on the article 21. It is thus desired to provide a roller electrode which is capable of providing a stable voltage to an article during rotation of the roller electrode.

SUMMARY OF THE INVENTION

The main object of the present invention is to provide a roller electrode which is capable of providing a stable voltage to an article to be plated in a continuous electroplating process for forming a high-quality coating on the article.

Accordingly, the roller electrode of the present invention is adapted to be connected to a terminal of a power supply, and includes an elongated hollow roller, a stationary shaft, and an electrically conductive fluid. The hollow roller and the stationary shaft are electrically conductive. The hollow roller has an inner surface which confines an interior chamber. The stationary shaft is provided coaxially in the interior chamber of the hollow roller and is journalled to the hollow roller. The stationary shaft has an end section which extends out of the interior chamber for connection to the terminal of the power supply. The fluid is provided in the interior chamber around the stationary shaft to provide a stable electrical connection between the stationary shaft and the hollow roller.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
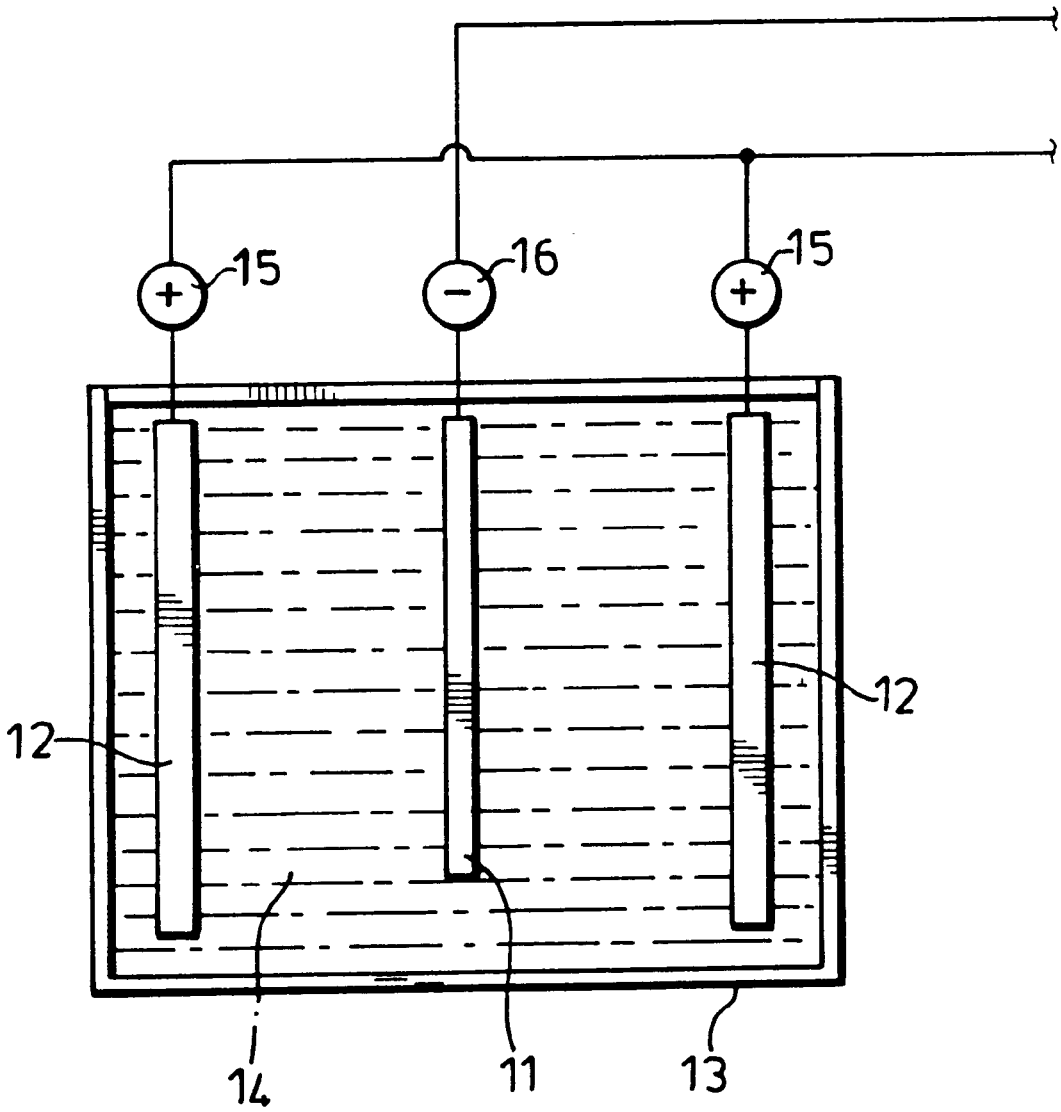
FIG. 1 PRIOR ART
FIG. 1 is a schematic view illustrating a conventional dip-type electroplating process.
Figure 2:
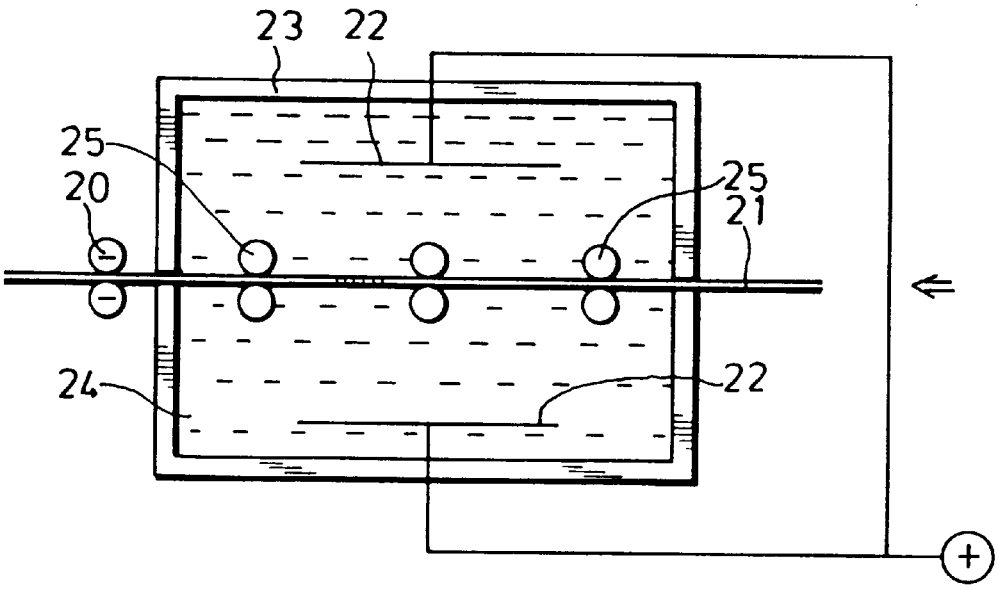
FIG.2 PRIOR ART
FIG. 2 is a schematic view illustrating a continuous electroplating process.
Figure 3:
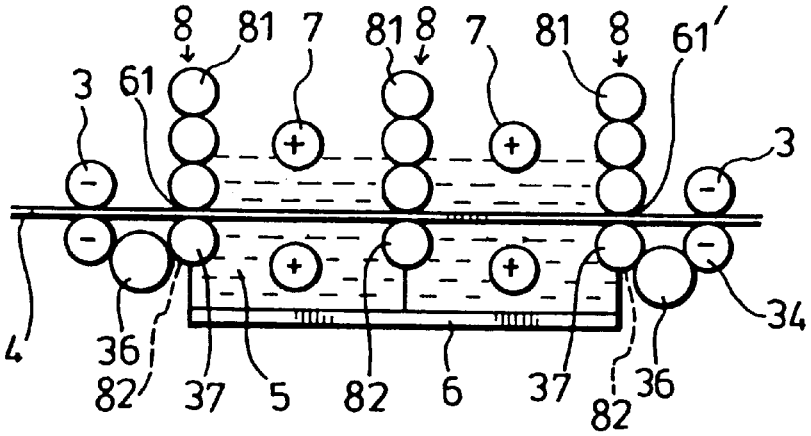
FIG. 3 is a schematic view illustrating another continuous electroplating process to be applied with the roller electrode of this invention.

The roller electrode 3 according to the preferred embodiment of the present invention can be used in the continuous electroplating process illustrated in FIG. 3. Referring to FIG. 3, a board article 4, such as a printed circuit board substrate, is advanced through an inlet and outlet 61 of a plating tank 6 which contains an electrolyte solution 5. A plurality of spraying tubes 7, which are electrically connected to a positive terminal of a power supply (not shown), are provided within the plating tank 6 at two opposite sides of the article 4 and are spaced from the article 4. The electrolyte solution 5, which contains ions of the plating metal, is sprayed from the spraying tubes 7 toward the article 4 that passes therebetween. A pair of the roller electrodes 3 is disposed outside the plating tank 6 adjacent to each of the inlet and outlet 61. The roller electrodes 3 are connected to a negative terminal of the power supply (not shown) and are in rolling contact with the board article 4 to form the article 4 into a cathode. A plurality of advancing roller units 8 are provided at the inlet 61 and outlet 61' of the plating tank 6 and within the plating tank 6. Each of the advancing roller units 8 includes a plurality of upper rollers 81 disposed above the article 4, and a lower roller 82 disposed under the article 4. The upper and lower rollers 81, 82 rotate about horizontal axes and cooperate to advance the article 4 smoothly along a horizontal pathway. The upper rollers 81 disposed at the inlet outlet 61' move downwardly after passage of the article 4 to close the inlet outlet 61' so as to prevent leakage of the electrolyte solution 5 and to prevent spraying of the same onto the roller electrodes 3 disposed outside the plating tank 6, thereby preventing the deposition of metal ions contained in the electrolyte solution 5 onto outer surfaces of the roller electrodes 3, which can affect adversely the conductivity of the roller electrodes 3.

Figure 4:
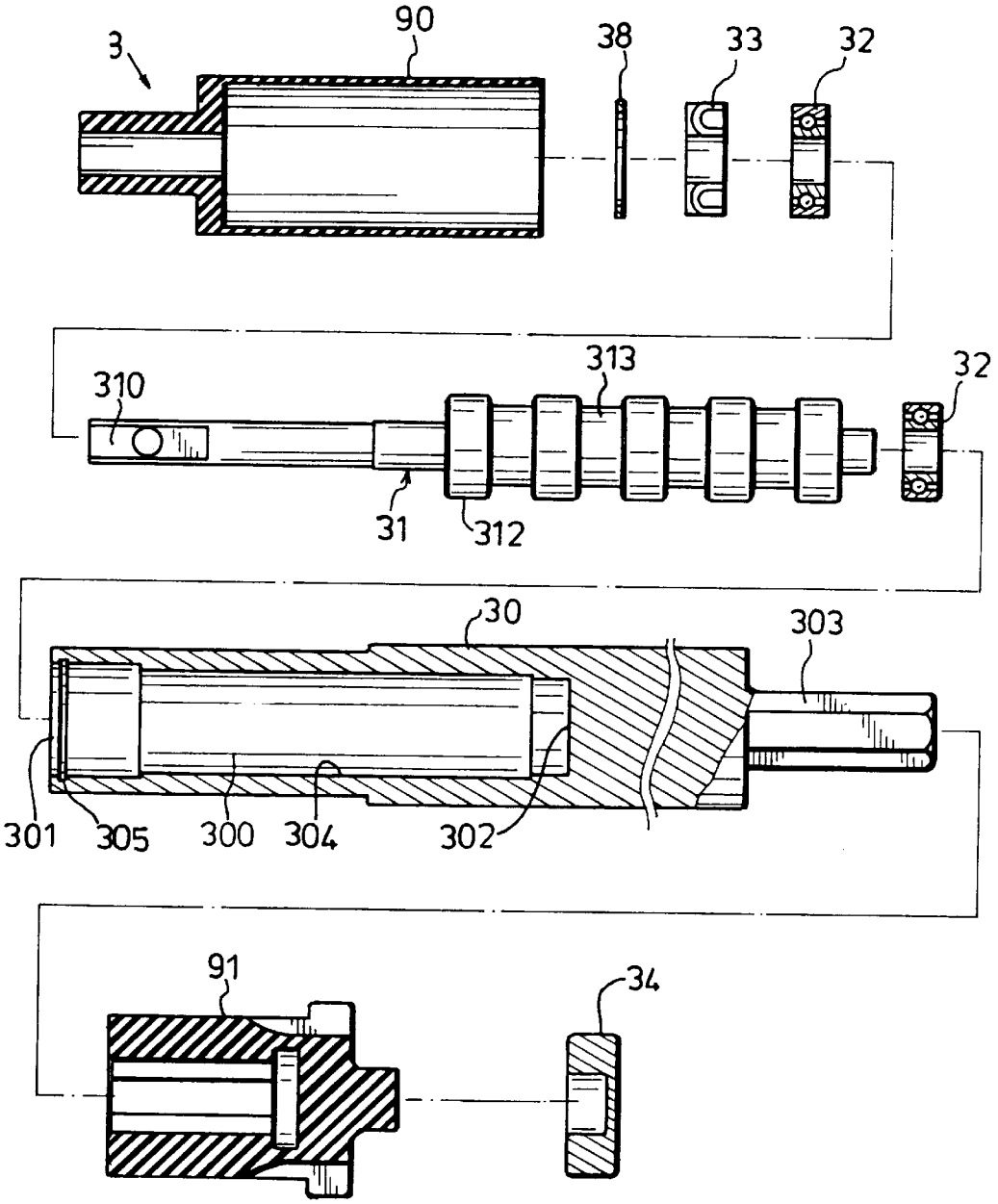
FIG. 4 is an exploded, sectional view of the roller electrode according to a preferred embodiment of the present invention.
Figure 5:
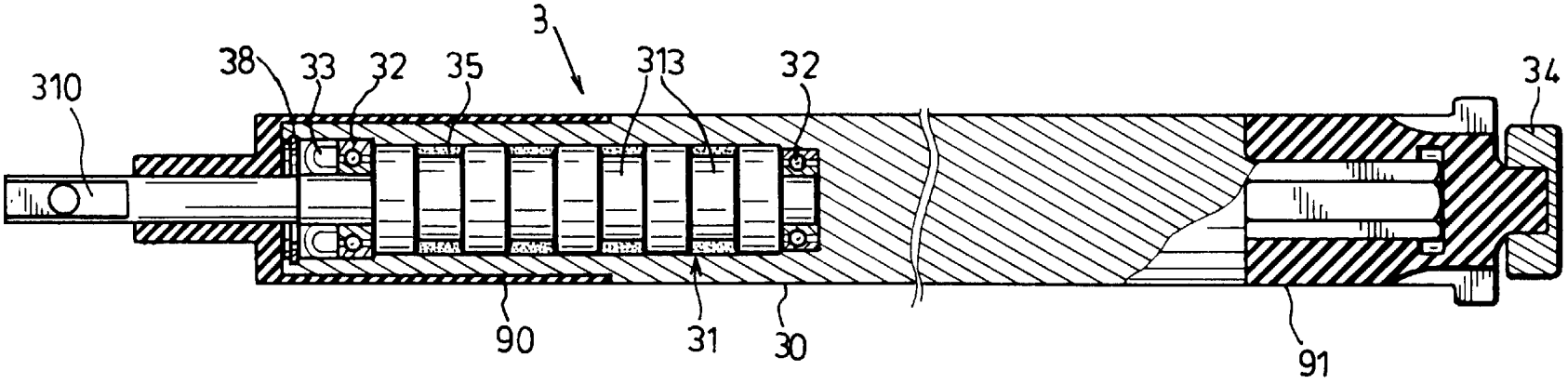
FIG. 5 is a sectional view of the roller electrode according to the preferred embodiment.

Referring to FIGS. 4 and 5, the roller electrode 3 of the present invention is shown to include an electrically conductive, elongated hollow roller 30, an electrically conductive stationary shaft 31, a pair of bearing units 32, a sealing member 33, an electrically conductive fluid 35 and a C-ring 38.

The hollow roller 30 has a closed end 303, an open end 301, and an inner surface 304 which confines an interior chamber 300. The stationary shaft 31 is preferably made of a metal with excellent electrical conductivity and is provided coaxially in the interior chamber 300 of the hollow roller 30. The stationary shaft 31 has a cylindrical outer surface 312 which extends substantially in full length of the interior chamber 300 and which substantially contacts the inner surface 304 of the hollow roller 30. As shown, the cylindrical outer surface 312 has a plurality of axially spaced annular grooves 313 filled with the electrically conductive fluid 35, preferably mercury. The stationary shaft 31 has an end section 310 which extends out of the interior chamber 300 for connection to the negative terminal of the power supply. The bearing units 32 are respectively provided in the open end 301 and on an inner side wall 302 of the roller 30 to support the stationary shaft 31 in the interior chamber 300 and to facilitate rotation of the hollow roller 30 relative to the stationary shaft 31. The sealing member 33 is sleeved on the stationary shaft 31 for closing the open end 301 in a fluid-tight manner. The C-ring 38 is retained in a retaining groove 305 that is formed in the inner surface 304 of the hollow roller 30 at the open end 301 for retaining the sealing member 33 and the bearing units 32 within the interior chamber 300.

The roller electrode 3 further includes first and second insulating sleeves 91, 90 made of an electrically insulating material. The first insulating sleeve 91 is sleeved on the closed end 303 of the hollow roller 30 to insulate electrically the closed end 303. The second insulating sleeve 90 is sleeved on the open end 301 of the hollow roller 30 to insulate electrically the open end 301. As shown, the closed end 303 of the roller 30 is formed as a coupling protrusion with a non-circular cross-section. The first insulating sleeve 91 has an inner surface conforming with the coupling protrusion so that the hollow roller 30 is rotatable together with the first insulating sleeve 91.

The roller electrode 3 may be further provided with a driven gear 34 so that the hollow roller 30 can be driven by an external force. The driven gear 34 is coupled to the first insulating sleeve 91. Referring again to FIG. 3, the driven gear 34 provided on each of the roller electrodes 3 engages a first gear 36 which, in turn, engages a second gear 37 provided on the shaft of an adjacent one of the lower rollers 82 such that the lower rollers 82 rotate together with the hollow rollers 30 of the roller electrodes 3 for advancing smoothly the board article 4 when the hollow rollers 30 are driven by an external force.

The electrically conductive fluid 35 in the interior chamber 300 of the hollow roller 30 provides a stable electrical connection between the hollow roller 30 and the stationary shaft 31 when the hollow roller 30 rotates. In the illustrated embodiment, the stationary shaft 31 is provided with a plurality of axially spaced, annular grooves 313 for maintaining the electrically conductive fluid 35 between the inner surface 304 of the hollow roller 30 and the outer surface 312 of the stationary shaft 31, thereby resulting in a stable electrical connection therebetween. The roller electrode 3 can thus provide a stable voltage to the board article 4 to ensure the quality of the coating that is deposited on the article 4.

With this invention thus explained, it is apparent that numerous modifications and variations can be made without departing from the scope and spirit of this invention. It is therefore intended that this invention be limited only as indicated in the appended claims.

I claim:

1. A roller electrode adapted to be connected to a terminal of a power supply, said roller electrode comprising:

an electrically conductive, elongated hollow roller having an inner surface which confines an interior chamber;

an electrical conductive stationary shaft provided coaxially in said interior chamber of said hollow roller and journalled to said hollow roller, said stationary shaft having an end section which extends out of said interior chamber for connection to the terminal of the power supply; said stationary shaft having a cylindrical outer surface which extends substantially in the full length of said interior chamber and which substantially contacts said inner surface of said hollow roller, said cylindrical outer surface having a plurality of axially spaced annular grooves filled with an electrically conductive fluid; and said electrically conductive fluid provided in said interior chamber around said stationary shaft to provide a stable electrical connection between said stationary shaft and said hollow roller.

2. The roller electrode as claimed in claim 1, wherein said electrically conductive fluid is mercury.

3. The roller electrode as claimed in claim 1, wherein said hollow roller further has a closed end, and an open end opposite to said closed end, said end section of said stationary shaft extending outward through said open end in a fluid-tight relationship therewith.

4. The roller electrode as claimed in claim 3, further comprising first and second electrically insulating sleeves which are respectively installed onto and which electrically insulate said closed and open ends.

5. The roller electrode as claimed in claim 4, further comprising a driven gear coupled to said first insulating sleeve.

6. The roller electrode as claimed in claim 1, further comprising a pair of bearing units to support said stationary shaft in said interior chamber.

* * * * *